United States Patent [19]

Kuhn

[11] Patent Number: 4,837,133

[45] Date of Patent: Jun. 6, 1989

[54] PHOTOGRAPHIC FOUR-COLOR MATERIAL FOR THE SILVER DYE BLEACH PROCESS

[75] Inventor: Jakob Kuhn, Marly, Switzerland

[73] Assignee: Ciba-Geigy AG, Basel, Switzerland

[21] Appl. No.: 943,942

[22] Filed: Dec. 9, 1986

[30] Foreign Application Priority Data

Dec. 10, 1985 [CH] Switzerland ..... 5261/85

[51] Int. Cl.[4] ..... G03C 7/02

[52] U.S. Cl. ..... 430/358; 430/391; 430/505; 430/508; 430/363; 430/444

[58] Field of Search ..... 430/358, 391, 505, 508, 430/944, 363

[56] References Cited

U.S. PATENT DOCUMENTS

| | | | |
|---|---|---|---|
| 2,074,259 | 3/1937 | Gaspar | 95/7 |
| 2,125,015 | 7/1938 | Gaspar | 95/2 |
| 4,609,609 | 9/1986 | Rohr et al. | 430/146 |
| 4,705,745 | 11/1987 | Kitchen et al. | 430/505 |

FOREIGN PATENT DOCUMENTS 2172118A 9/1986 United Kingdom .

*Primary Examiner*—Richard L. Schilling
*Attorney, Agent, or Firm*—Wenderoth, Lind & Ponack

[57] ABSTRACT

There is disclosed a photographic four-color material for the silver dye bleach process, which material, in addition to containing the customary yellow, magenta and cyan image dyes, contains a black layer which is sensitive to infra-red light.

The material is suitable e.g. for testing dotted or continuous tone color separation positives.

3 Claims, No Drawings

PHOTOGRAPHIC FOUR-COLOR MATERIAL FOR THE SILVER DYE BLEACH PROCESS

The present invention relates to a novel photographic four-colour material for the silver dye bleach process and to the use of said material for testing colour separation positives for four-colour printing.

In the printing industry, high-quality colour reproductions are made almost exclusively by means of four-colour printing. The procedure comprises four colour separations on top of one another, the red filter separation giving the cyan print, the green filter separation the magenta print, and the blue filter separation the yellow print. Black and grey images are reproduced with the black separation. Faults or defects in colour separations prepared by photographic means can only be recognised in this method from a proof print of the four printing formes.

However, as the preparation of the printing formes is laborious and expensive, there has been no lack of attempts to use photographic colour materials for testing colour separations instead of a proof print. The testing of the half-tone positives required for photogravure printing is possible up to a certain degree. However, as conventional colour materials have only three coloured layers, viz. yellow, magenta and cyan, the black separation has to be assigned proportionately to the three coloured layers. This division of the black separation, however, can easily result in adulteration of the colour saturation and reproduction of shade, especially in the high-light areas.

The known photographic materials are not suitable for testing colour separations for offset printing, as dotted colour separations are used in offset printing and half-tone dots can only be copied onto these materials with substantial losses in quality.

It is the object of the present invention to provide a novel silver dye bleach material which can be used for testing dotted and continuous tone colour separation positives instead of a proof print.

This object is achieved according to the invention by providing a photographic four-colour material for the silver dye bleach process, which material contains, in addition to the yellow, magenta and cyan layers, at least one further layer which is sensitive to infra-red light and which contains at least one black image dye.

The images obtained with the photographic material of this invention have good consistency with the later print, have excellent sharpness, and are easy to process.

Further objects of the invention are the use of the photographic material of the invention for testing colour separation positives for four-colour printing as well as a process for the preparation of control images for colour separation positives in photogravure printing and in lithoprinting or offset printing.

The four-colour material of this invention can also be used as three-colour copying material by simple homogeneous exposure of the black dye element with infra-red light.

It is known that conventional silver dye bleach materials contain photographic elements with a yellow, a magenta and a cyan image dye. In addition to these photographic elements, the material of this invention comprises a further element that contains a black image dye which is sensitive to infra-red light.

In this specification, the term "photographic elements" shall be understood as meaning one or more photographic layers which, together, are responsible for producing a specific monochromatic, positive partial image, e.g. a magenta image, in a multi-colour material. Accordingly, a photographic element can consist of e.g. at least one silver halide emulsion layer containing an image dye (i.e. a yellow, magenta, cyan or black dye), or of a combination of at least one silver halide emulsion layer and at least one silver halide-free layer containing an image dye, which image dye may also be incorporated into the silver halide emulsion layer of such a combination. Such photographic elements are known per se and are described e.g. in CH Pat. Nos. 383.355 and 456.434, in U.S. Pat. Nos. 2,391,198 and 2,183,394, in GB Pat. No. 483.464 and in U.S. Pat. No. 4,391,884.

The material of this invention preferably contains photographic elements that comprise (a) a single layer containing silver halide and image dye, (b) viewed from the support, a silver halide-free, dye-containing layer superimposed on a layer containing silver halide and, optionally, image dye, or (c) two silver halide-free, dye-containing layers with an interlayer containing silver halide and image dye.

The photographic elements (b) and (c) are especially important, as the arrangement of the layers in these elements effects a comparably pronounced sharpness of the reproduced object and it is also possible to reproduce half-tone originals without loss of quality.

The photographic material of this invention contains the photographic element with the black image dye, preferably directly above the support or above a backing applied to the support. The elements with a cyan, magenta and yellow dye can then be arranged above this element in the normal sequence.

Preferably the order of the layers in these elements corresponds to that in the element containing the black image dye. However, the order in which the layers are arranged may also vary.

In addition to containing the individual photographic elements, the material of this invention may contain the per se known conventional covering layers and interlayers. For example, in the material of the invention the individual elements may be separated by interlayers which consist substantially of a binder such as gelatin. The interlayers may contain additives such as the bleach inhibitors disclosed in EP 117.227. Preferably a yellow filter layer which, in addition to a yellow image dye, contains e.g. colloidal silver, is present between the element containing a yellow image dye and a magenta image dye.

In individual cases it can be advantageous to apply an antihalation backing that absorbs infra-red light direct to the layer support.

Black image dyes suitable for use in the material of this invention are listed e.g. in U.S. Pat. No. 4,609,609.

These image dyes preferably have the formula (100)
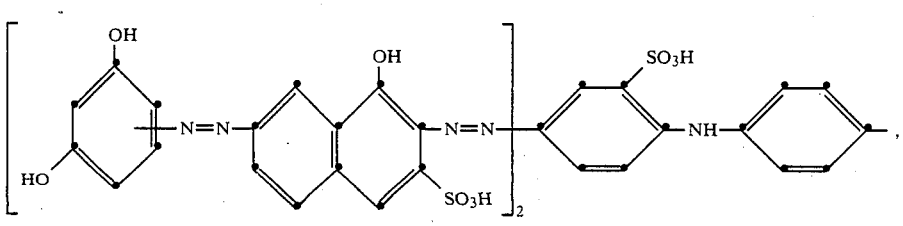
especially the formula
(101)
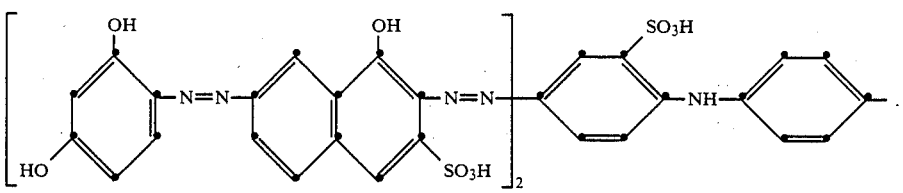
Further compounds that are especially suitable image dyes for the material of the invention have the formulae
(102)
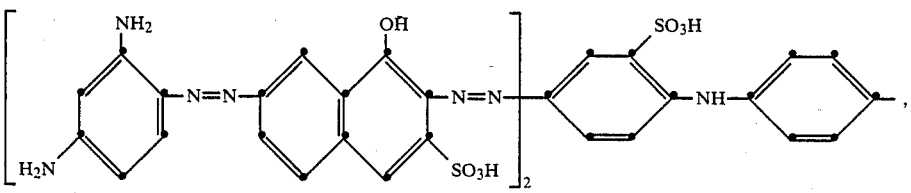
(103)
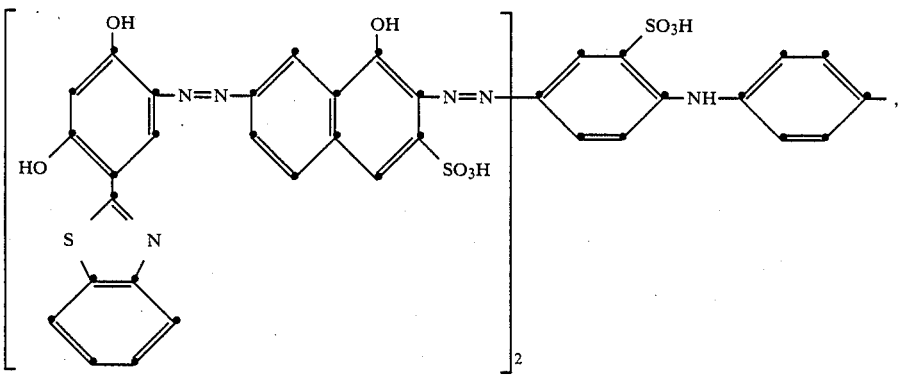
(104)
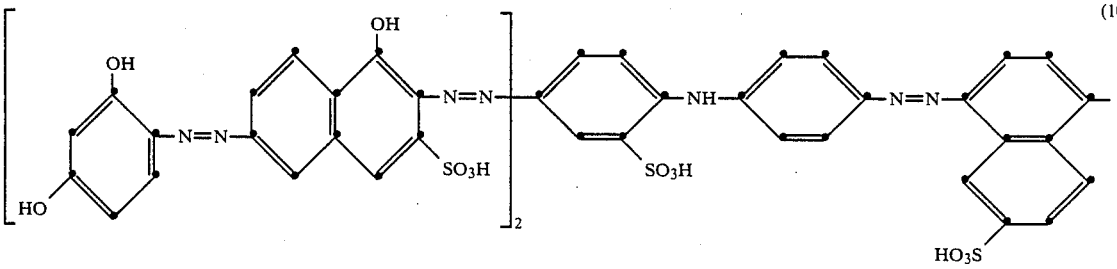
and -continued

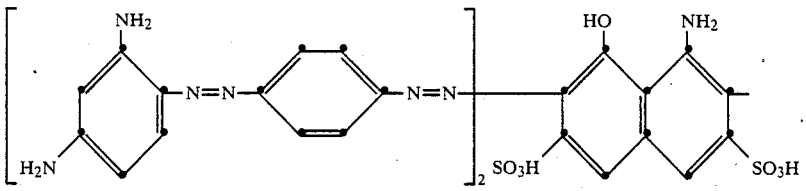

(105)

As yellow, magenta and cyan dyes it is possible to use e.g. the known bleachable azo dyes, preferably the water-soluble diffusion-resistant azo dyes disclosed in CH Pat. No. 572.230. Also suitable, however, are the oil-soluble azo dyes disclosed e.g. in EP Nos. 39.312, 40.171, 40.172 and 59.166.

Silver halide emulsions suitable for the material of this invention are the conventional emulsions described e.g. in in Research Disclosure No. 17643, December 1978, Research Disclosure No. 22534, January 1983, in GB Pat. Nos. 1.507.989, 1.520.976, 1.596.602 and 1.570.581 and DE No. 3.241.634, 3.241.638, 3.241.641, 3.241.643, 3.241.645 and 3.241.647. The chemical and spectral sensitisation of these emulsions is also effected by methods which are known per se, e.g. as described in Research Disclosure No. 17643, Sections IIIA and IV and in Research Disclosure No. 22534, pp. 24–28.

Suitable binders or dispersants for the silver halides and image dyes are the customary colloids such as gelatin or gelatin derivatives, optionally in conjunction with other colloids. Suitable binders or dispersants are described e.g. in Research Disclosure No. 17643, Section IX. Compounds that can be used as hardeners for the silver halide emulsions are also disclosed in Section X of this publication.

To the eligible silver halide emulsions ma be added a great number of further modifiers, e.g. antifogging agents, stabilisers and compounds for reducsing the pressure sensitivity. These and further modifiers are known and described e.g. in C.E.K. Mees, The Theory of the Photographic Process, 2nd Edition, Macmillan, 1985, pp. 677–680, and Research Disclosure No. 17643, Sections V, VI, VII, VIII, XI–XIV, XVI, XX and XXI.

A very wide range of conventional layer supports such as the polymer films, papers, metallic foils, glass supports and supports made of ceramic materials described in Research Disclosure No. 17643, Section VII, may also be used for the preparation of the materials of this invention.

The exposure of the material of this invention can be effected in conventional manner. If the material is used especially for checking colour separation positives as replacement proof print, then it can be exposed additively in a manner known per se through a blue, green, red and black separation positive as illustrated in Example 1.

Processing of the exposed material of the invention is carried out by the known process steps such as silver developing, dye bleaching and fixing as well as one or more washings. Silver bleaching can be combined on occasion with dye bleaching and/or fixing in a single processing step. Suitable methods of processing are described in detail e.g. in DE Nos. 1 924 723, 2 258 076, 2 423 814, 2 448 433, 2 547 720 and 2 651 969.

The invention is illustrated by the following non-limitative Examples.

EXAMPLE 1

The following layers are applied in the indicated sequence on to an opaque white support:

1. A layer comprising 0.9 g/m$^2$ of gelatin, 0.090 g/m$^2$ of the black dye of formula

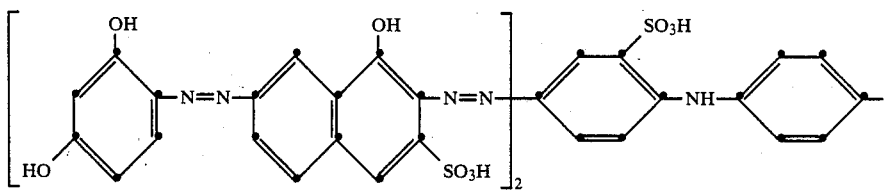

(101)

and 0.35 g/m$^2$ of silver as IR-sensitive, monodispersed silver bromide emulsion.

2. An interlayer comprising 1.5 g/m$^2$ of gelatin.

3. A layer comprising 1.1 g/m$^2$ of gelatin and 0.1 g/m$^2$ of the cyan dye of formula

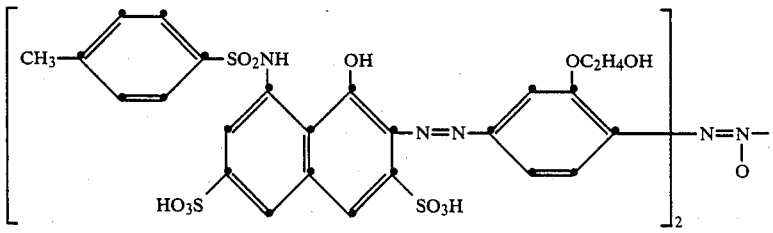

(106)

and 0.300 g/m$^2$ of silver as red-sensitive, monodispersed silver bromide emulsion.

4. An interlayer comprising 1.5 g/m$^2$ of gelatin.

5. A layer comprising 1.2 g/m$^2$ of gelatin and 0.122 g/m$^2$ of the magenta dye of formula

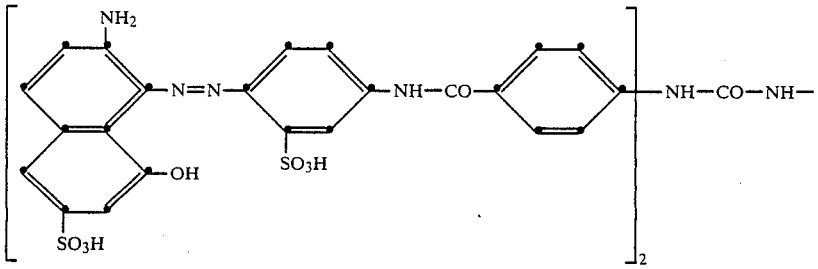

(107)

and 0.25 g/m² of silver as green-sensitive, monodispersed silver bromide emulsion.

6. A yellow filter layer comprising 1.6 g/m², 0.054 g/m² of the yellow dye of formula

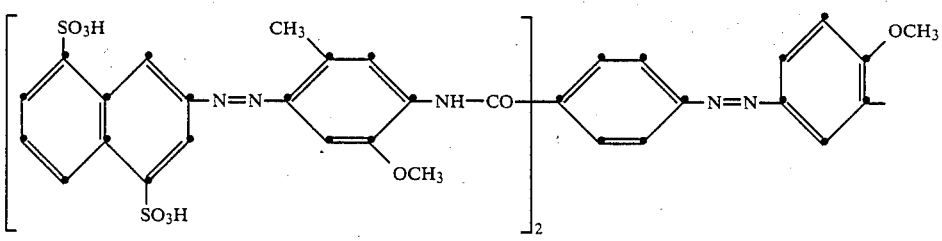

(108)

and 0.041 g/m² of colloidal silver.

7. A layer comprising 0.8 g/m² of gelatin, 0.060 g/m² of the yellow dye of formula (108) and 0.20 g/m² of silver as blue-sensitive, monodispersed silver bromide emulsion.

8. A protective layer comprising 1.2 g/m² of gelatin.

The material further comprises 0.29 g/m² of 2-amino-4-hydroxy-6-(4-methylmorpholinium)-1,3,5-triazine-tetrafluoroborate as hardener.

This material is exposed additively in the following manner through continuous half-tone colour separation positives: blue separation through a blue filter, green separation through a green filter, red separation through a red filter and black separation through an IR filter.

After processing the material, a control image is obtained of the colour separation positives with information on the shade and colour reproduction properties of the colour plates. This control image is substantially equivalent to a corresponding photogravure proof print.

Processing is carried out as follows:

| | |
|---|---|
| developing | 1.5 minutes |
| washing | 0.5 minute |
| silver and dye bleaching | 1.5 minutes |
| washing | 0.5 minute |
| fixing | 1.5 minute |
| washing | 3.0 minutes |
| drying | |

The temperature of the respective baths is 30° C.

The developing bath contains the following components:

| | |
|---|---|
| sodium sulfite | 38.0 g/l |
| potassium sulfite | 19.0 g/l |
| lithium sulfite | 0.6 g/l |
| 1-phenyl-3-pyrazolidinone | 1.0 g/l |

-continued

| | |
|---|---|
| hydroquinone | 12.0 g/l |
| potassium carbonate | 29.1 g/l |
| potassium bromide | 1.5 g/l |
| benztriazole | 0.5 g/l |
| ethylenediamine tetraacetic acid (sodium salt) | 4.0 g/l |

The silver bleaching bath has the following composition:

| | |
|---|---|
| concentrated sulfuric acid | 56.3 g/l |
| sodium m-nitrobenzenesulfonate | 6.0 g/l |
| potassium iodide | 8.0 g/l |
| hydroxyethylpyridinium chloride | 2.4 g/l |
| 2,3-dimethylquinoxaline | 2.5 g/l |
| 4-mercaptobutyric acid | 1.8 g/l |

The fixing bath contains:

| | |
|---|---|
| ammonium thiosulfate | 200.0 g/l |
| ammonium metabisulfite | 24.0 g/l |

Similar results are obtained by replacing 0.090 g/m² of the dye of formula (101) with 0.075 g/m² of the dye of formula (102) or 0.109 g/m² of the dye of formula (103) or 0.084 g/m² of the dye of formula (104) or 0.102 g/m² of the dye of formula (105).

EXAMPLE 2

The following layers are applied in the indicated sequence on to an opaque white support:

1. A layer comprising 0.6 g/m² of gelatin and 0.030 g/m² of the black dye of formula (101).

2. A layer comprising 0.6 g/m² of gelatin and 0.030 g/m² of the black dye of formula (101) and 0.35 g/m² of silver as IR-sensitive, monodispersed silver bromide emulsion.

3. A layer comprising 0.6 g/m² of gelatin and 0.030 g/m² of the black dye of formula (101).

4. A layer comprising 0.6 g/m² of gelatin and 0.033 g/m² of the cyan dye of formula (106).

5. A layer comprising 0.6 g/m² of gelatin and 0.033 g/m² of the cyan dye of formula (106) and 0.30 g/m² of silver as red-sensitive silver bromide emulsion.

6. A layer comprising 0.6 g/m² of gelatin and 0.033 g/m² of the cyan dye of formula (106).

7. A layer comprising 0.6 g/m² of gelatin and 0.041 g/m² of the magenta dye of formula (107).

8. A layer comprising 0.6 g/m² of gelatin, 0.041 g/m² of the magenta dye of formula (107) and 0.25 g/m² of silver as green-sensitive silver bromide emulsion.

9. A layer comprising 0.6 g/m² of gelatin and 0.041 g/m² of the magenta dye of formula (107).

10. A yellow filter layer comprising 1.2 g/m² of gelatin, 0.054 g/m² of the yellow dye of formula (108) and 0.041 g/m² of colloidal silver.

11. A layer comprising 0.6 g/m² of gelatin and 0.030 g/m² of the yellow dye of formula (108).

12. A layer comprising 0.6 g/m² of gelatin, 0.030 g/m² of the yellow dye of formula (108) and 0.20 g/m² of silver as blue-sensitive silver bromide emulsion.

13. A protective layer comprising 1.2 g/m² of gelatin.

The material additionally contains 2-amino-4-hydroxy-6-(4-methylmorpholinium)-1,3,5-triazine-tetrafluoroborate as hardener.

Dotted colour separation positives are exposed on to the material, which is then processed as described in Example 1.

A sharp control image is obtained of the mosaic colour separation positives with information on dot and colour reproduction properties of the colour plates. This control image is substantially equivalent to a corresponding offset proof print.

The same result is obtained by using the same amount of the dye of formula (100) instead of the dye of formula (101).

Similar results are obtained by replacing in layers 1 to 3 0.030 g/m² of the dye of formula (101) with 0.025 g/m² of the dye of formula (102) or 0.036 g/m² of the dye of formula (103) or 0.028 g/m² of the dye of formula (104) or 0.034 g/m² of the dye of formula (105).

What is claimed is:

1. A process for the preparation of dotted colour separation positives for offset printing which comprises exposing a photographic material, which comprises on a support in the following order a gelatin layer containing a black dye and an IR sensitive silver halide emulsion, a silver halide free gelatin layer containing a black dye, a gelatin layer containing a cyan dye and a red sensitive silver halide emulsion, a silver halide free gelatin layer containing a cyan dye, a gelatin layer containing a magenta dye and a green sensitive silver halide layer, a silver halide free gelatin layer containing a magenta dye, a silver halide free gelatin layer containing a yellow dye and a gelatin layer containing a yellow dye and a blue sensitive silver halide emulsion, through the blue, green, red and black separation positive with blue, green, red and infra red light, respectively, then developing, silver dye bleaching and fixing the exposed material.

2. A process according to claim 1, wherein the black image dye has the formula

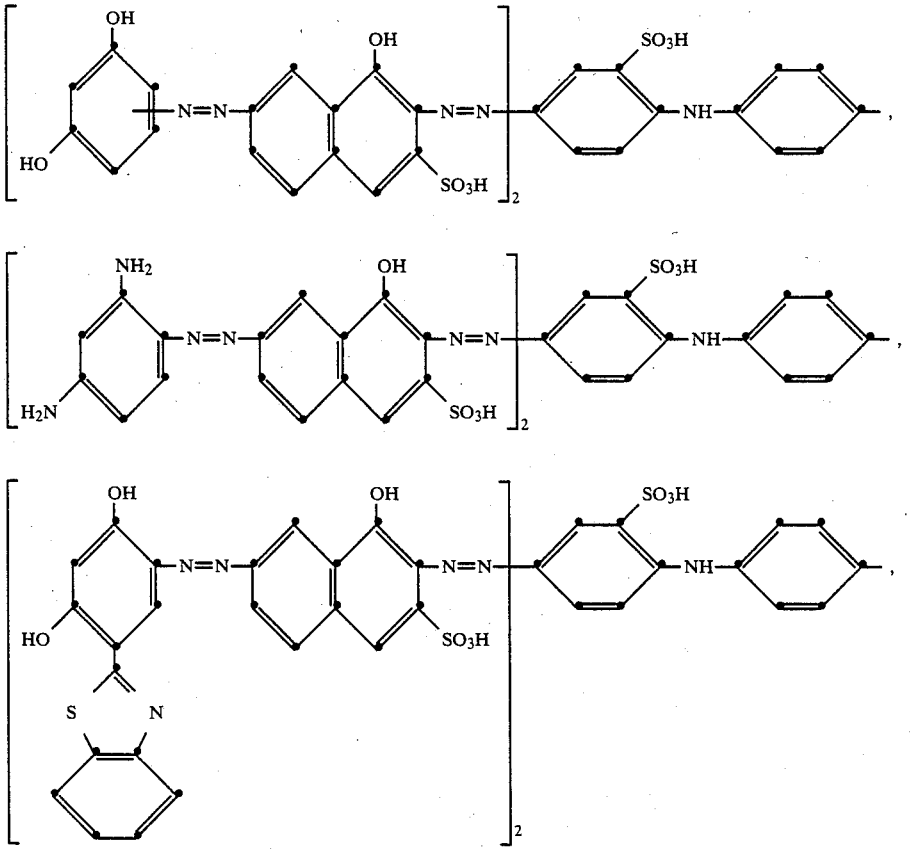

-continued
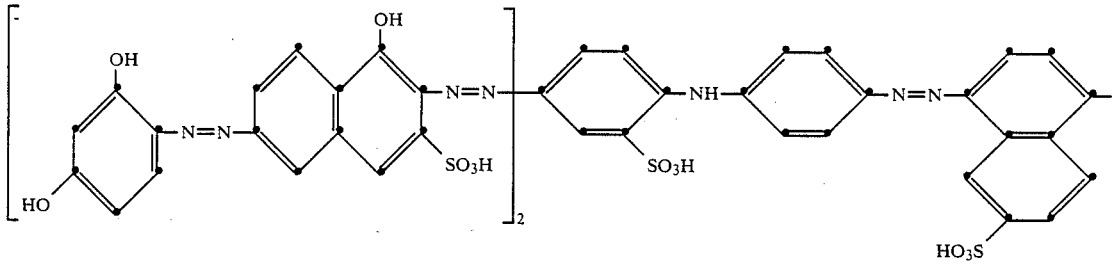
or
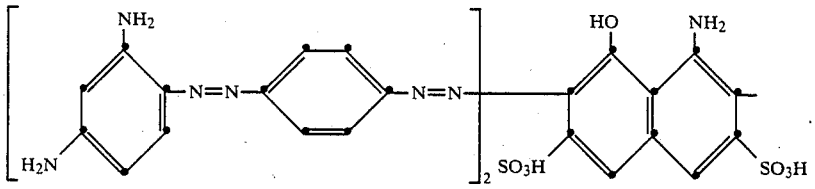
3. A process according to claim 1, wherein the layers containing the black, cyan, magenta and yellow dye are separated from one another by interlayers.
* * * * *